US007766721B2

(12) United States Patent
Ma

(10) Patent No.: US 7,766,721 B2
(45) Date of Patent: Aug. 3, 2010

(54) INTERNALLY ILLUMINATED TUBULAR TOY

(75) Inventor: Chor-Ming Ma, Kowloon (CN)

(73) Assignee: Buzz Bee Toys (H.K.) Co., Limited, Kowloon, Hong Kong (CN)

( * ) Notice: Subject to any disclaimer, the term of this patent is extended or adjusted under 35 U.S.C. 154(b) by 45 days.

(21) Appl. No.: 12/316,049

(22) Filed: Dec. 8, 2008

(65) Prior Publication Data

US 2010/0048097 A1 Feb. 25, 2010

(30) Foreign Application Priority Data

Aug. 19, 2008 (HK) ..... 08109276

(51) Int. Cl.
*A63H 33/30* (2006.01)

(52) U.S. Cl. ..... 446/485; 446/473

(58) Field of Classification Search ..... 446/175, 446/219, 242, 473, 485; 362/101, 102, 186, 362/202

See application file for complete search history.

(56) References Cited

U.S. PATENT DOCUMENTS

| | | | | |
|---|---|---|---|---|
| 4,915,666 | A | 4/1990 | Maleyko | |
| 5,356,343 | A * | 10/1994 | Lovetere | 472/57 |
| 6,070,987 | A * | 6/2000 | Jarvik | 362/84 |
| 6,626,559 | B1 * | 9/2003 | Lin | 362/249.01 |
| 2007/0254553 | A1 | 11/2007 | Wan | |

* cited by examiner

*Primary Examiner*—Nini Legesse
(74) *Attorney, Agent, or Firm*—Alix, Yale & Ristas, LLP

(57) ABSTRACT

A toy sword has a translucent foam shell in the form of a blade. A light-transmissive tube is located within the foam shell and a multitude of light emitters are located along the tube and are configured to emit light through the tube to the foam shell from inside to illuminate the shell's exterior.

13 Claims, 6 Drawing Sheets

INTERNALLY ILLUMINATED TUBULAR TOY

BACKGROUND OF THE INVENTION

The present invention relates to tubular toys for young children. The invention more particularly, although not exclusively, relates to internally illuminated toys in elongate tubular form such as the form of a sword, or in circular tubular form such as the form of a hoop.

Toy swords and hoops are of course known. Some are known to be internally illuminated such as for example toy "light sabres" inspired by the movies like Star Wars.

Some such toys, whilst suitable for children of certain age groups, might be unsuitable for younger children as their external surfaces are hard and could possibly inflict injury in use.

SUMMARY

An improved illuminated tubular toy is provided.

There is disclosed herein a toy, comprising:

a light-transmissive foam shell;

a light-transmissive tube located within the foam shell;

a multitude of light emitters located along the tube and configured to emit light through the tube to the foam shell.

Preferably, the toy further comprises an elongate member located within or adjacent to the tube and upon which the light emitters are mounted.

Preferably, the tube is translucent so as to diffuse light from the light emitters.

Preferably, the toy further comprises a plurality of bulkheads spaced internally along the shell and through which the tube extends, or with which the tube is integrally formed, the bulkheads serving to maintain the shell in a fixed relationship about the tube.

Alternatively, the toy further comprises a filler tube located within the shell alongside the tube.

Preferably, the toy further comprises circuitry selectively controlling illumination of the light emitters.

Preferably, the light emitters comprise LEDs.

Preferably, the foam shell and tube are substantially linear.

Preferably, the toy further comprises a handle attached to one end of the foam shell and/or tube and housing a battery for powering the light emitters.

Alternately, the foam shell and tube are curved to form a segment of a hoop.

In this alternative, the toy typically further comprises a hoop section to which the foam shell and/or tube are connected and housing a battery for powering the light emitters.

Preferably, the foam shell and light-transmissive tube are flexible.

Preferably, the elongate member is flexible.

BRIEF DESCRIPTION OF THE DRAWINGS

Preferred forms will now be described by way of example with reference to the accompanying drawings, wherein.

DESCRIPTION OF THE PREFERRED EMBODIMENTS

Figure 1:
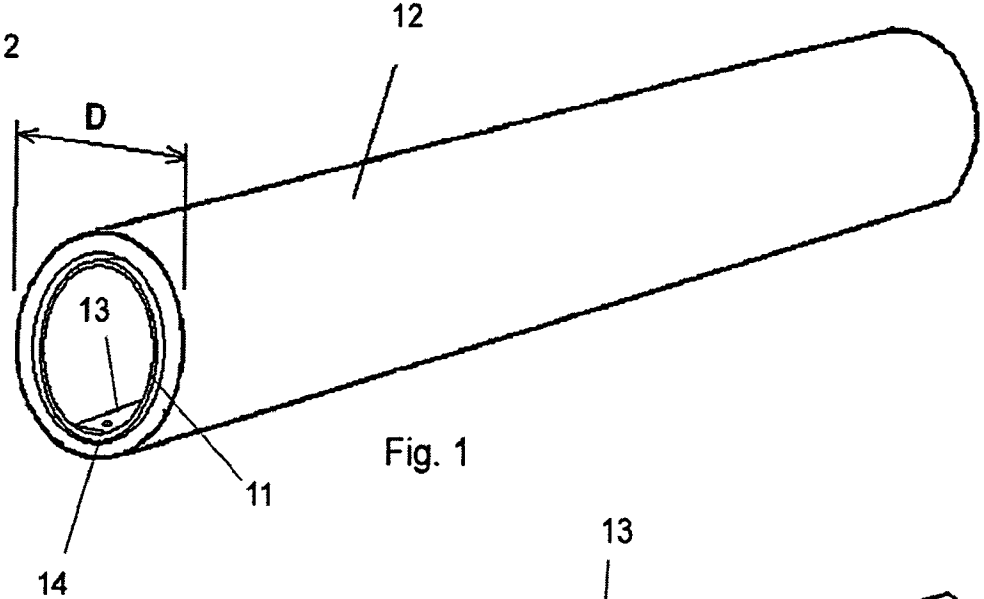
FIG. 1 is a schematic perspective illustration of a foam shell about a tube within which there is an array of LEDs.
Figure 2:
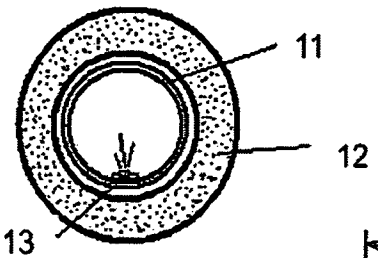
FIG. 2 is a schematic cross-sectional end elevation of what is depicted in FIG. 1.

In FIGS. 1 and 2 of the accompanying drawings, there is depicted schematically a foam shell 12 which is typically made of flexible lightweight material such as PE (polyethylene) or EPP (expanded polyethylene). The shell 12 is lightweight and preferably flexible so that it will bend if it strikes an object in use. Alternately the foam shell 12 might be of more rigid yet lightweight material such as EPP (expanded polypropylene) or EPS (expanded polystyrene). Whichever material is chosen, it ought to be of relatively low surface hardness for safety reasons. Also, the chosen material should be light-transmissive and preferably translucent so that light which impinges on its inner surface propagates through the material to illuminate its exterior.

Located within the shell 12 is a light-transmissive diffuser tube 11 which is preferably flexible, but might alternatively be resistant to bending. There is an annular air gap separating the external surface of the diffuser tube 11 and the internal surface of the shell 12. The diffuser tube 11 is typically of translucent plastics material, or other light-transmissive material such as polypropylene tubing with diffusive surface features. As an alternative—and where the shell itself is translucent—the tube might be transparent. The diffuser tube 11 is typically of higher hardness than the shell 12.

Figure 5:
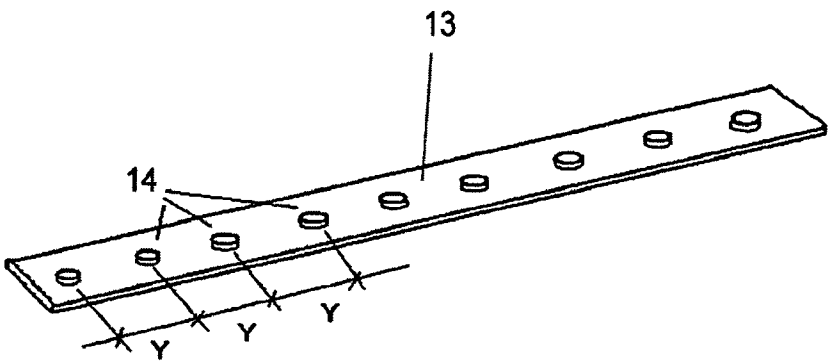
FIG. 5 is a schematic perspective illustration of an elongate circuit board having mounted thereto an array of LEDs.
Figure 6:
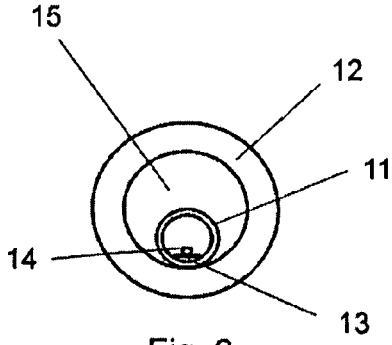
FIG. 6 is a schematic end elevation of a foam shell about an offset tube within which there is an array of LEDs.
Figure 7:
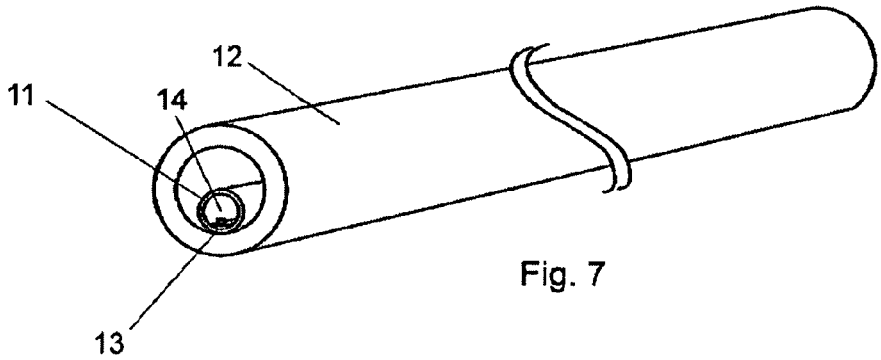
FIG. 7 is a schematic perspective illustration of what is depicted in FIG. 6.
Figure 8:
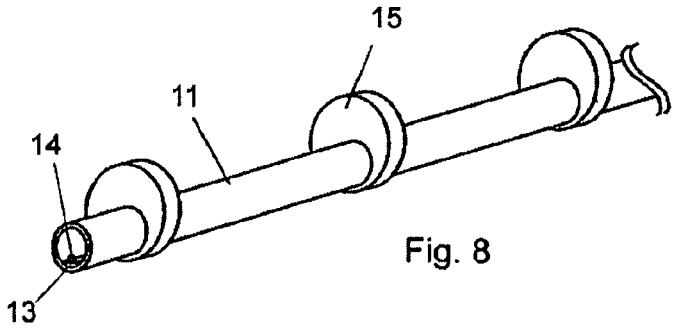
FIG. 8 is a schematic perspective illustration of the offset tube also depicting a plurality of bulkheads through which the tube extends or with which the tube is integrally formed.
Figure 9:
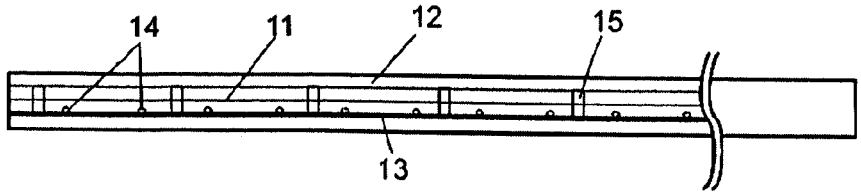
FIG. 9 is a schematic cross-sectional elevation of what is depicted in FIGS. 6 and 7.

Extending longitudinally of the diffuser tube 11 is a circuit board strip 13 having a plurality of LEDs 14 mounted thereto. An example of such a strip is depicted in FIG. 5. Where the shell 12 and diffuser tube 11 are flexible, the circuit board strip 13 would also be flexible. For rigid components, the circuit board strip 13 would typically be rigid. The LEDs 14 may be provided in a linear array at one side or both sides of the strip. The LEDs 14 are positioned along the circuit board strip 13 in a linear array in which the spacing "Y" between adjacent LED centres is between 0.3 and 1.5 times "D" in which D is the external diameter of the foam tube 12 as depicted in FIG. 1.

FIG. 2 depicts an embodiment in which the circuit board strip 13 is located at or internally adjacent of the diffuser tube 11 so that each LED emits light toward an opposite internal surface of the diffuser tube 11.

Figure 3:
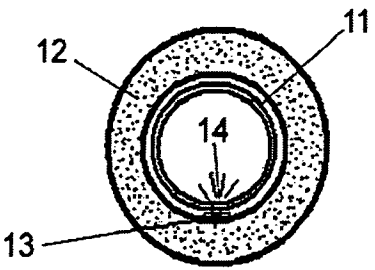
FIG. 3 is a schematic cross-sectional end elevation of an alternative LED-mounting arrangement.

FIG. 3 depicts an embodiment in which the circuit board strip 13 is located at or externally adjacent to the diffuser tube 11 so that each LED emits light through a wall of the diffuser tube toward the wall diametrically opposite. In this arrangement, the diffuser tube 11 could have an array of apertures into each of which one of the LEDs extends.

Figure 4:
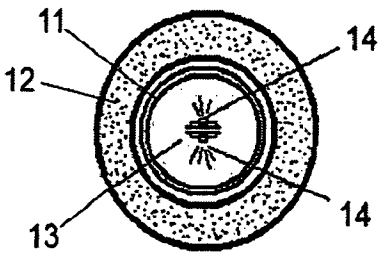
FIG. 4 is a schematic cross-sectional end elevation of a further alternative LED-mounting arrangement.

FIG. 4 depicts an embodiment in which a circuit board strip, 13 having LEDs at both sides, is located centrally of the diffuser tube 11 so as to emit light at respective diametrically opposed internal surfaces of the diffuser tube.

In the above-mentioned embodiments, the diffuser tube 11 is located centrally of the shell 12 to substantially fill the shell. Alternatively, the diffuser tube can be somewhat smaller in diameter and centrally located as shown in FIGS. 13 to 16, or laterally offset as depicted in FIGS. 6 to 9. In each of these embodiments, the diffuser tube 11 has spaced longitudinally thereabout a plurality of bulkheads 15 which engage the inner surface of the shell 12 to maintain an offset position of the diffuser tube 11 therein. In these embodiments, the circuit board strip 13 is positioned laterally to one side of the diffuser tube 11 and has an array of LEDs 14 all facing in the same direction. In the embodiment of FIGS. 6 to 9, the proximity of the diffuser tube 11 to one side of the shell 12 maintains a spread of light at the external surface of the shell 12 that is quite even despite the close proximity of the LEDs to one side of the diffuser tube and the close proximity of the diffuser tube itself to one side of the shell. This is brought about somewhat by the fact that the LEDs are all facing toward the diametrically opposed side of the diffuser tube and shell. The embodiment of FIGS. 13 to 16 in which the diffuser tube 11 is centrally located can still provide an even light spread if the tube 11 has good diffusive properties.

Figure 10:
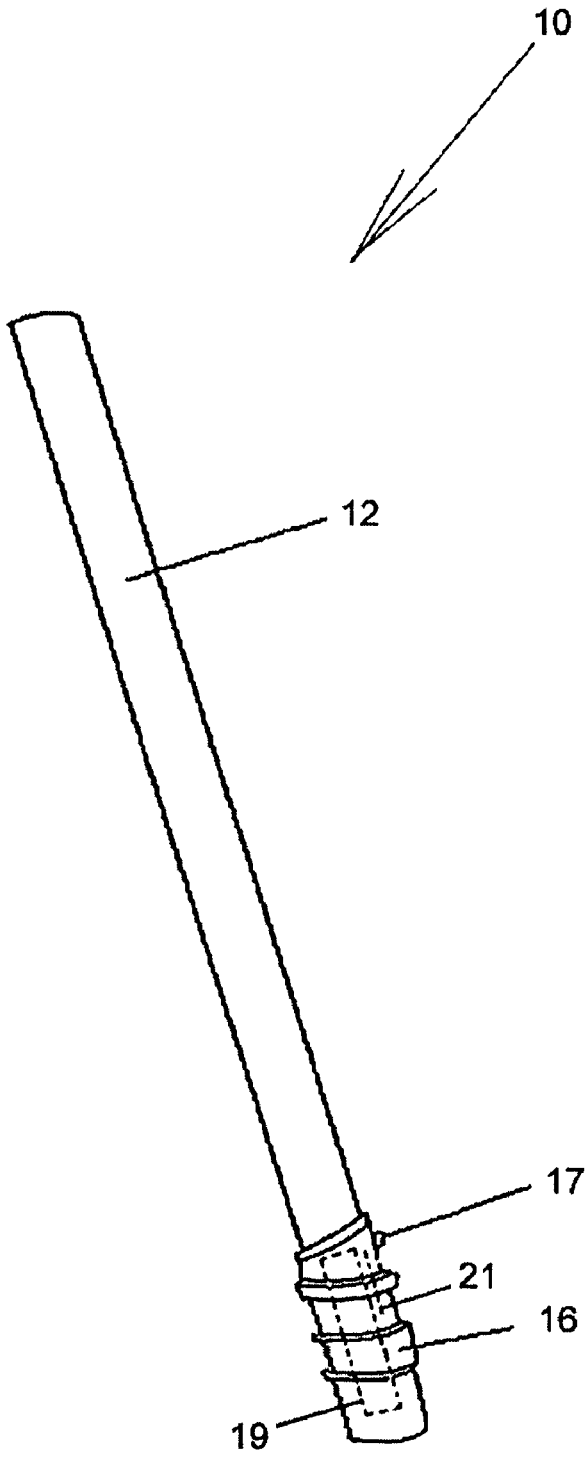
FIG. 10 is a schematic perspective illustration of a toy sword having a "blade" comprising features depicted in any one of FIGS. 1 to 9.
Figure 11:
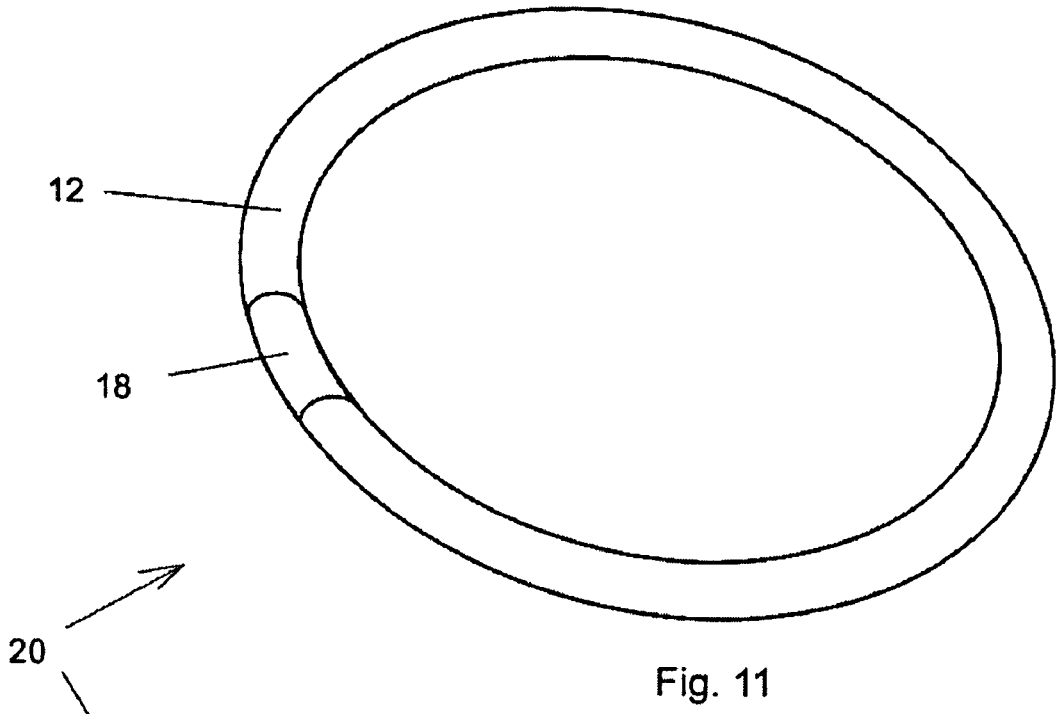
FIG. 11 is a schematic perspective illustration of a hoop.
Figure 12:
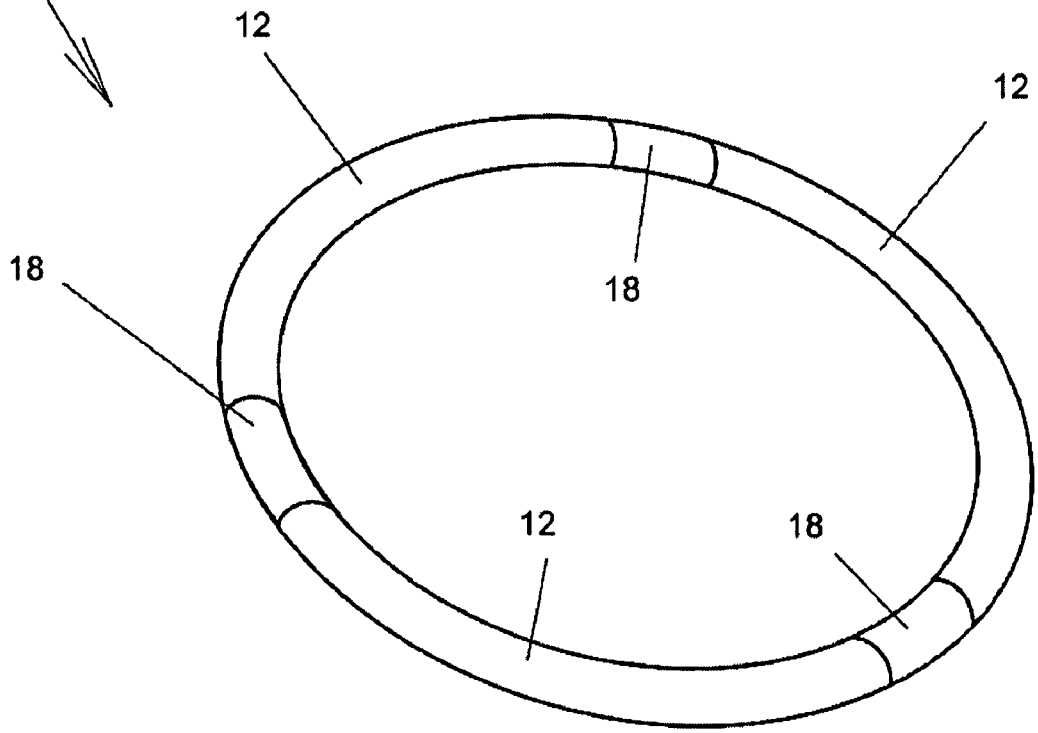
FIG. 12 is a schematic perspective illustration of another hoop.
Figure 13:
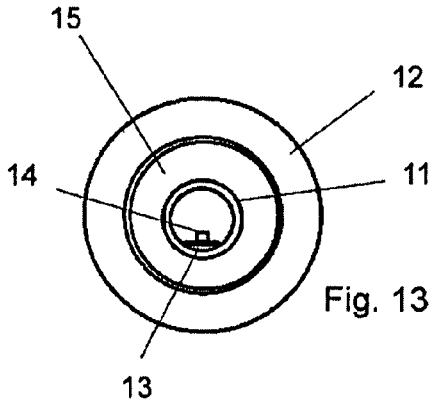
FIG. 13 is a schematic end elevation of a foam shell about a centred tube within which there is an array of LEDs.
Figure 14:
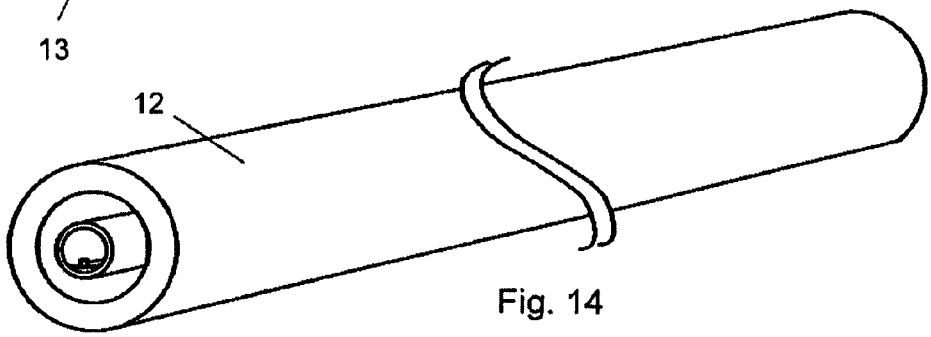
FIG. 14 is a schematic perspective illustration of what is depicted in FIG. 13.
Figure 15:
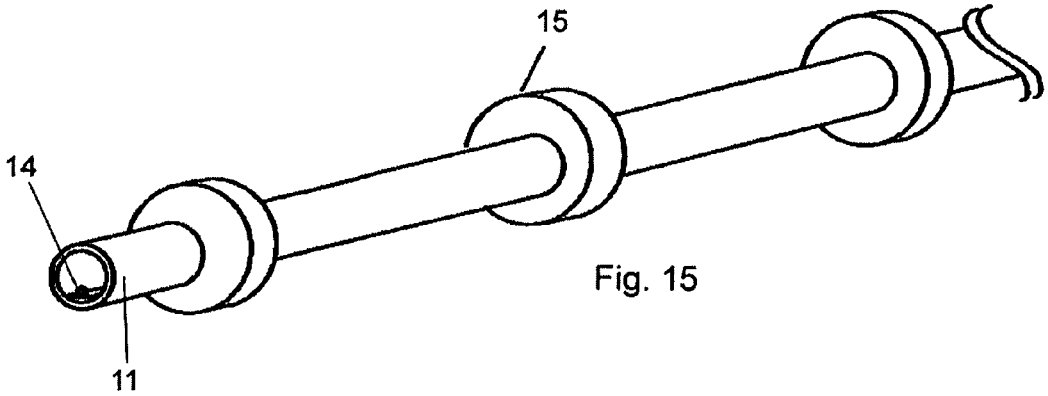
FIG. 15 is a schematic perspective illustration of the centred tube also depicting a plurality of bulkheads through which the tube extends or with which the tube is integrally formed.
Figure 16:
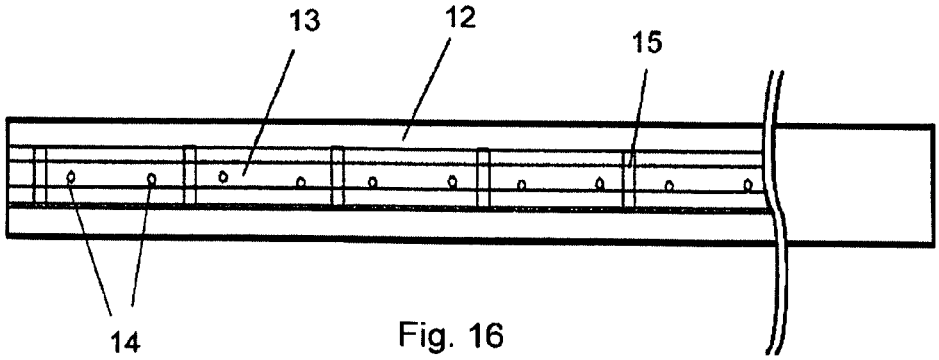
FIG. 16 is a schematic cross-sectional elevation of what is depicted in FIGS. 13 and 14.

Some toys incorporating the above or similar features are depicted in FIGS. 10 to 12. A toy sword 10 as depicted in FIG. 10 includes an elongated linear "blade" comprising shell 12 and associated internal components as described above. These extend from a handle 16 within which a battery 19 would be located and within which control circuitry 21 for selectively illuminating the LEDs would be provided. The control circuitry might include a light chaser circuit for example. A trigger switch 17 is provided to activate the circuitry and LEDs.

Alternative hoops 20 are depicted in FIGS. 11 and 12. In FIG. 11, the overall hoop is identified at 12 and is basically a curved version of the linear shell depicted in the preceding figures. The hoop 12 comprises internal components the same as those described above, but curved within the hoop. The hoop may be moulded in this curved shape or simply bent from linear components. Connecting and closing the shell 12 to form a continuous hoop is a moulded plastics connecting segment 18 which would typically contain a battery and control circuitry as described above with reference to the handle 16.

The embodiment of FIG. 12 comprises three shell segments 12 and three connecting segments 18—at least one of which would contain a battery and control circuitry.

Figures 17, 18, 19, 20:
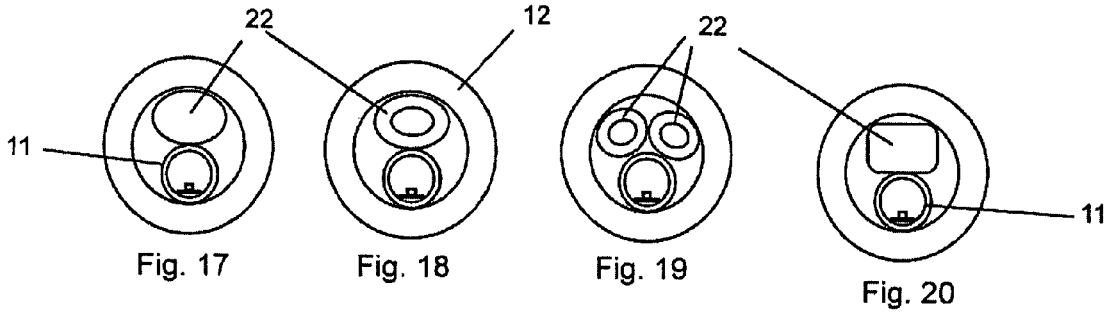
FIGS. 17 to 20 are schematic end elevations of foam shells about offset tubes within which there is an array of LEDs and a variety of filler tubes.
Figures 21, 22:
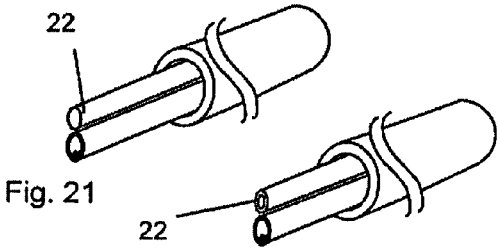
FIGS. 21 to 24 a schematic perspective illustration is of what is shown in FIGS. 17 to 20 respectively.
Figure 23:
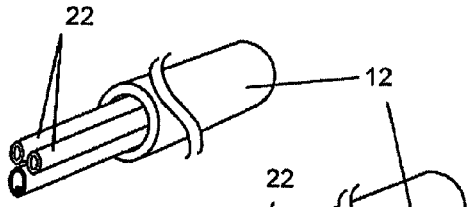
Figure 24:
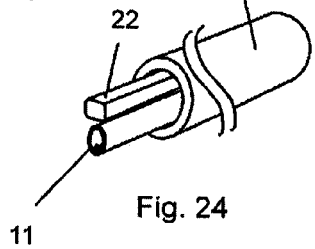
Figure 25:
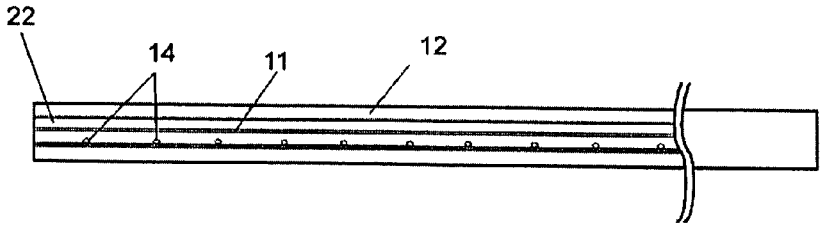
FIG. 25 is a schematic cross-sectional elevation of what is depicted in FIG. 22.

FIGS. 17 to 25 depict alternative embodiments—each comprising a laterally offset diffuser tube 11. In these embodiments a filler tube 22 occupies a portion of the space between the outer surface of the diffuser tube 11 and the inner surface of the foam shell 12. The filler tube 22 is typically made of light-transmissive foam material which might be solid as shown for example in FIGS. 17, 20, 21 and 24, or hollow as shown in FIGS. 18, 19, 22 and 23. One or more filler tubes can be provided. For example, FIGS. 19 and 23 show a pair of hollow filler tubes 22. The filler tubes can be of any cross-sectional shape such as circular, oval, square, rectangular or otherwise. The filler tubes perform a locating role to prevent free movement of the diffuser tube 11 within the foam shell 12.

It should be appreciated that modifications and alterations obvious to those skilled in the art are not to be considered as beyond the scope of the present invention. For example, the LEDs may be of any available colour or might indeed be multi-coloured LEDs capable of changing colour in sequence for example. Where the shell is of white coloured foam material for example, then it could appear to glow in different colours. As a further option, the light emitters could comprise incandescent bulbs instead of LEDs.

The invention claimed is:

1. A toy, comprising:

a light-transmissive foam shell;

a light-transmissive tube located within the foam shell;

a multitude of light emitters located along the tube and configured to emit light through the tube to the foam shell.

2. The toy of claim 1, further comprising an elongate member located within or adjacent to the tube and upon which the light emitters are mounted.

3. The toy of claim 2, wherein the elongate member is flexible.

4. The toy of claim 1, wherein the tube is translucent so as to diffuse light from the light emitters.

5. The toy of claim 1, further comprising a plurality of bulkheads spaced internally along the shell and through which the tube extends, or with which the tube is integrally formed, the bulkheads serving to maintain the shell in a fixed relationship about the tube.

6. The toy of claim 1, further comprising a filler tube located within the shell alongside the tube.

7. The toy of claim 1, further comprising circuitry selectively controlling illumination of the light emitters.

8. The toy of claim 1, wherein the light emitters comprise LEDs.

9. The toy of claim 1, wherein the foam shell and tube are substantially linear.

10. The toy of claim 9, further comprising a handle attached to one end of the foam shell and/or tube and housing a battery for powering the light emitters.

11. The toy of claim 1, wherein the foam shell and tube are curved to form a segment of a hoop.

12. The toy of claim 11, further comprising a hoop section to which the foam shell and/or tube are connected and housing a battery for powering the light emitters.

13. The toy of claim 1, wherein the foam shell and light-transmissive tube are flexible.

* * * * *